US006408729B1

(12) United States Patent
Johnson

(10) Patent No.: US 6,408,729 B1
(45) Date of Patent: Jun. 25, 2002

(54) STEEL RULE FOR SCRAP MATERIAL EJECTION DIE

(76) Inventor: Michael J. Johnson, 1669 Lou Graham, El Paso, TX (US) 79936

( * ) Notice: Subject to any disclaimer, the term of this patent is extended or adjusted under 35 U.S.C. 154(b) by 0 days.

(21) Appl. No.: 09/376,437

(22) Filed: Aug. 18, 1999

(51) Int. Cl.[7] ..... B26F 1/14; B26F 1/44; B26D 7/18

(52) U.S. Cl. ..... 83/697; 83/55; 83/164; 83/684; 83/686; 83/698.91; 83/694; 453/82; 453/342; 453/373

(58) Field of Search ..... 83/697, 55, 123–125, 83/128, 145, 652, 651, 684, 695, 685, 698.71, 698.91, 699.11, 911, 936, 405, 653, 686, 620, 694, 679, 164, 165; 76/107.8; 25/97; 93/82, 83, 342, 373

(56) References Cited

U.S. PATENT DOCUMENTS

| | | | | |
|---|---|---|---|---|
| 1,177,005 A | | 3/1916 | Zimmerman | |
| 1,309,157 A | * | 7/1919 | Stockman | 83/123 X |
| 1,321,896 A | | 11/1919 | Davis | |
| 2,097,693 A | | 11/1937 | Foster et al. | |
| 2,191,709 A | * | 2/1940 | Dedrick | 83/652 |
| 2,313,801 A | | 3/1943 | Carll | |
| 2,561,050 A | * | 7/1951 | Chrron et al. | 83/55 X |
| 3,205,750 A | | 9/1965 | Strange | |
| 3,335,628 A | | 8/1967 | Simms et al. | |
| 3,411,208 A | | 11/1968 | Malm | |
| 3,492,903 A | * | 2/1970 | Malm | 83/652 |
| 3,599,520 A | | 8/1971 | Wood | |
| 3,626,799 A | | 12/1971 | Gerber | |
| 3,826,170 A | | 7/1974 | Jones et al. | |
| 4,601,228 A | | 7/1986 | Steadman et al. | |
| 4,607,553 A | * | 8/1986 | Hartzell | 83/164 |
| 4,754,677 A | | 7/1988 | McKindary | |
| 4,829,854 A | | 5/1989 | Kämmerling-Essmann | |
| 4,921,154 A | | 5/1990 | Abe et al. | |
| 4,981,061 A | | 1/1991 | Hillock et al. | |
| 5,129,295 A | | 7/1992 | Geffros et al. | |
| 5,402,698 A | | 4/1995 | Morrison | |
| 5,676,032 A | | 10/1997 | Johnson | |

FOREIGN PATENT DOCUMENTS

| | | |
|---|---|---|
| DE | 43 04 030 A1 | 8/1994 |
| WO | WO 89/06184 | 7/1989 |

OTHER PUBLICATIONS

Pictures of a Die for making Shoe Sole Parts (9 sheets) Admitted Prior Art.

* cited by examiner

*Primary Examiner*—Boyer Ashley
(74) *Attorney, Agent, or Firm*—Banner & Witcoff, Ltd.

(57) ABSTRACT

Improved steel rule for use in a cutting die for cutting fixed patterns in a single or plurality of stacked material layers according to the shape of the steel rule. The improvement in the rule assists in the removal of small pieces of scrap material through the bottom of the die. The rule is undercut so that the gap between adjacent cavities is tapered. The tapered gap between adjacent cavities creates a vertical passageway that becomes wider toward the bottom of the passageway. This greatly facilitates removal of scrap material through the bottom of the die. By allowing scrap material to escape through the die, the operators are not required to stop periodically to clean the die, and the likelihood of scrap material becoming trapped in the die is minimized. Thus, the speed of the cutting operation is increased and life of the die may be prolonged.

17 Claims, 8 Drawing Sheets

STEEL RULE FOR SCRAP MATERIAL EJECTION DIE

CROSS-REFERENCE TO RELATED APPLICATIONS

This application is related to copending patent application entitled Steel Rule Die With Scrap Material Ejection filed simultaneously herewith and which is incorporated herein.

FIELD OF THE INVENTION

This invention relates to steel rule for use in a cutting die and more particularly to rule for a die that facilitates the expulsion of scrap material from the gaps between rule patterns in the die.

BACKGROUND OF THE INVENTION

Steel rule cutting dies are commonly used for cutting cloth and cloth-like materials such as natural textiles, and synthetic materials such as vinyl. Steel rule dies are particularly advantageous in the repetitive cutting of specific shapes such as clothing, furniture, and automotive interior panels. In brief, a steel rule cutting die typically includes a base substrate or backing board. A length of sharpened blade, known as steel rule, is formed to the shape of the pattern to be cut and is attached to the base substrate with the sharpened cutting edge extending upwardly from the substrate. The die is used in conjunction with a cutting table and a press which may be either single cut or progressive feed. A single cutting die is often constructed with multiple separated rule pieces, to form what is commonly called cutting units or cavities, to enable cutting of multiple patterns with a single pass through the press.

Although the numerous cutting units of the die can sometimes be nested in an efficient manner to reduce scrap, a certain amount of scrap material is inherently produced due to the gaps between adjacent cutting units. Because of the large number of pieces of material cut from a single die, even a small amount of scrap material per piece can add up to a large waste for the manufacturer. Accordingly, reducing the gap between the adjacent cavities could provide substantial savings for the many manufacturers. It is therefore desirable to reduce the gap between adjacent cutting units.

Because of this need to minimize the amount of scrap material, the pieces of rule of adjacent cutting units are frequently placed extremely close together. In regions where two adjacent cutting units are in close proximity to each other, pieces of scrap material may be pinched, wedged, or otherwise trapped between the sections of rule of the adjacent cutting units. This is caused due to the cut scrap material being compressed laterally by the thickness of the outer bevel of the rule on both sides of the gap during the cutting process. The small gaps prevent the scrap material from fully expanding and can sometimes wedge between the rule. Scrap material that becomes stuck in the gaps is difficult and time consuming to remove. Additionally, it has been found that as the scrap material is removed from between adjacent cutting units, smaller pieces of scrap material and lint still remain behind in between the cavities. After numerous cutting operations, the small pieces of scrap material and lint can build up and damage the rule or otherwise inhibit the ability of the die to cut material. Accordingly, adjacent cavities of the die must be separated from one another by a gap sufficiently large to allow for scrap material to be removed after the cutting operation is complete.

In an attempt to eliminate the problem of scrap material becoming lodged in the small gaps, U.S. Pat. No. 5,676,032 to Johnson, the inventor of this application, discloses a steel rule die with closely nested cavities. The specification and drawings of that patent are incorporated herein by reference. This patent discloses the use of offset bevel rule to reduce the gap between the rule of adjacent cutting units, and removed sections of the substrate to permit scrap material to pass therethrough. After the cutting of stack sheets of material, the majority of scrap material can be manually removed from the-die. The small amount of frayed scrap material that would normally remain between the die of adjacent cavities is permitted to fall through the removed sections of the substrate. However, this solution is less than perfect because small pieces of scrap material can still get stuck and wedge between the closely-spaced rule of adjacent cutting units.

It would be desirable to have rule designed for use with a die having closely spaced cavities that does not suffer from the build up of frayed scrap material and enhances the ability to remove the scrap material from between the rule of adjacent cutting units. Preferably, the removal of built up scrap material should not require any additional labor, and it should not increase the time required to perform a cutting process.

SUMMARY OF THE INVENTION

According to the present invention, rule for use on adjacent cutting units of a die has a recess or undercut that facilitates the removal of scrap material from between adjacent pieces of rule. The portion of the rule that is undercut is below the cutting edge and on the outside surface of the rule relative to the cutting unit. This helps to a wide passageway for scrap material to fall out through the bottom of the die. As lint and small pieces of frayed material accumulate after each cutting operation, they are forced out of the bottom of the die during the subsequent cutting operation. Therefore, the scrap material never builds up between cutting units to an extent that would inhibit or slow the cutting process or that would cause damage to the die.

The undercut in the steel rule can take a variety of shapes as long as the side surface of the rule that is facing an adjacent cutting unit is spaced farther away from the adjacent cutting unit from the top of the rule to the bottom. The top of the rule, immediately below the sharpened bevel, should be the widest part of the rule. The bottom of the rule, where it attaches to the substrate, should be the narrowest part of the rule. The undercut can take the form of one or more discrete stairstep tapers, or it can take the form of a linear taper in the width of the rule.

It is a further objective of the present invention to provide rule for use in a multi-cavity die with adjacent cutting units in close proximity with each other in which scrap material is easily expelled after a cutting operation.

It is a further objective of the present invention to provide rule for use in a multi-cavity die in which the rule is undercut to allow for expulsion of material after a cutting operation.

The foregoing and other objects and advantages of the invention will be more fully understood from the following detailed description of the invention and from the accompanying drawings.

DETAILED DESCRIPTION OF THE INVENTION

Figure 1:
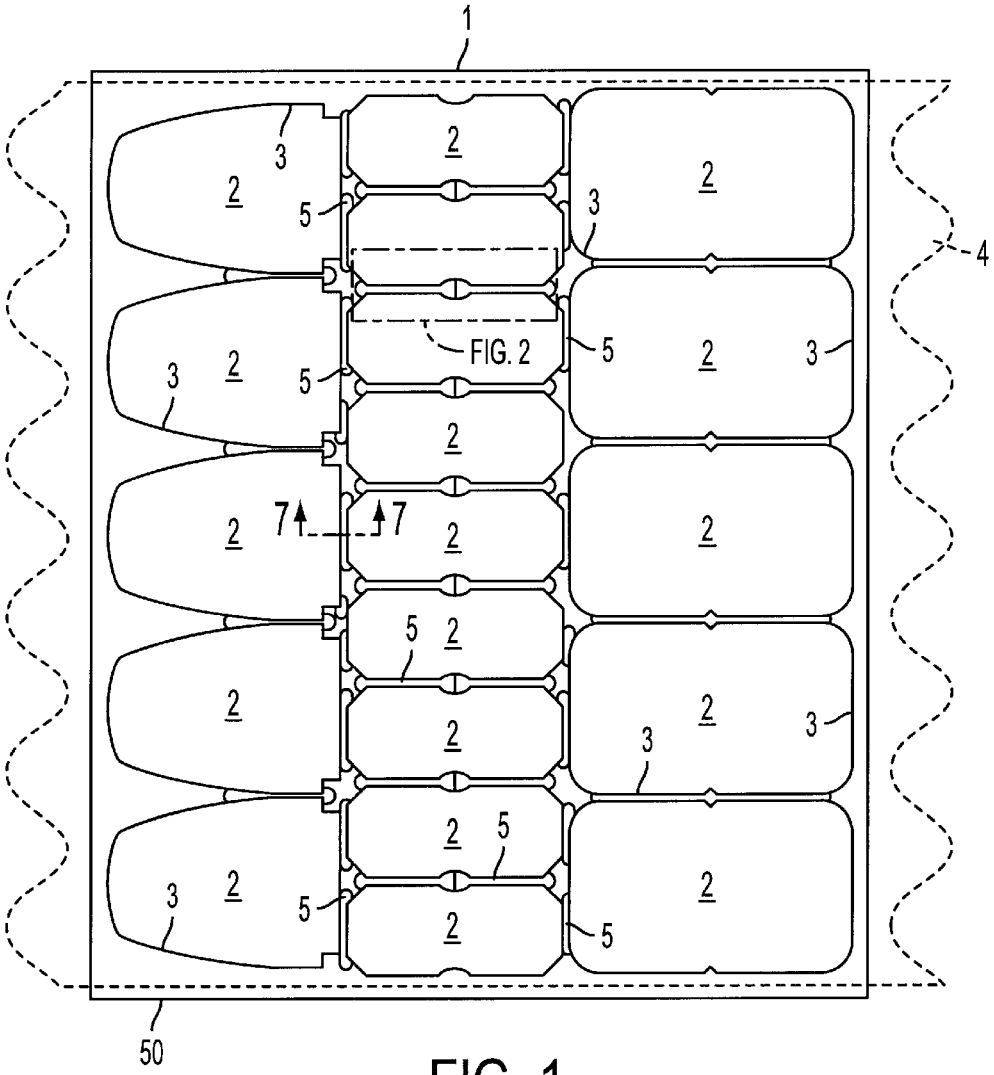
FIG. 1 is a plan view of a die with features to facilitate scrap material ejection according to the present invention.

As shown in FIG. 1, the die 50 of the present invention consists of a backing board, or substrate 1 to which various size and shaped cutting units 2 are attached. The substrate 1 is typically made of wood and is rectangular shaped, measuring several feet on each side.

Each cutting unit 2 is formed from an endless length of steel rule 3 that is directly or indirectly attached to substrate 1. The rule 3 is bent into the appropriate shapes to form the desired cutting patterns and is subsequently attached to the substrate. In preferred embodiments as shown in FIGS. 7–10, each cutting unit 2 includes a base 9 and the steel rule 3 is attached to the base 9. The base 9 is then attached to the substrate 1 to support and fix the position of the rule 3 relative to the substrate 1. As described in conjunction with FIGS. 7–10, the base 9 is preferably a secondary substrate made of wood, or can be made of sheet metal or plural metal braces.

A brief overview of the operation of the die 50 is described in conjunction with FIGS. 7–10. The die 50 is placed between a pair of platens 16, 36, and on top of the lower platen 36. One or more material sheets 4 of cloth, vinyl, foam, carpeting, or other sheet-like material is laid upon the die 50 so that the sheets 4 are superimposed upon the die 50. Typically, several material sheets 4 will be stacked upon each other and laid as a group on the die 50. A hydraulically powered press, not shown, pushes one platen towards the other until the sharpened rule 3 cuts through the sheets 4. The material sheets 4 will be cut into multiple pieces that correspond to the shapes of the rule 3 of the various cutting units 2. Pieces of scrap material will also exist between the rule 3 of adjacent cutting units 2. Typically, after such a cutting operation, the die 50 is separated from the lower platen 36. An operator then removes the desired cut pieces of material and also cleans out the large pieces of scrap material from between the rule 3 of adjacent cutting units 2. Small pieces of scrap material are likely to break away from the larger pieces of scrap and remain in the tight areas between closely spaced cutting units. It is common to shuttle the dies 50 in and out of the platen area on roller conveyors, not shown.

To prevent the often difficult and time consuming process of trying to remove small process of scrap material 17 from between adjacent cutting units 2 placed closely together, and in order to prevent small pieces of scrap material and lint from building up between adjacent cutting units 2, the substrate 1 is removed from the regions where cutting units 2 are closely spaced. That is, an elongated hole 5, i.e., a cutout or removed portion, is provided in the substrate 1 in regions where the rule 3 of adjacent cutting units 2 are closely spaced. By removing a portion of the substrate 1, small pieces of scrap material 17 and lint that are left between the adjacent cutting units 2 will fall or pass through the bottom of the die 50. This scrap material drops through the die 50 when the die 50 is shuttled from the platen area or when it is pushed downward upon subsequent cutting operations.

The present invention creates a widened horizontal passageway P between the adjacent cutting units 2 that widens at some areas, from top to bottom, to facilitate the falling and passing of the scrap material 17. According to the present invention, the width of the passageway P increases through the area of the adjacent rule, through the area of the substrate 1, or through both.

The passageway P is formed by the outer facing elements on the adjacent cutting units 2 and the opposing sidewalls of a cutout in the substrate 1 that enables scrap material to vertically pass therethrough. The entire passageway extends between the outer surfaces 7 of the rule 3 of adjacent cutting units 2 and between the sidewalls 34 of a removed portion 5 in the substrate 1 that form a channel permitting the scrap material 17 to vertically fall or pass therethrough. The rule passageway P. is the portion of the entire passageway from the cutting edge 8 of the rule 3 to the bottom 32 of the rule 3. The substrate passageway P is the portion of the entire passageway from the top 41 of the substrate 1 to the bottom 42 of the substrate To reduce the possibility of the scrap material becoming trapped in the die 1, the width of the removed portion 5 in the substrate 1 between adjacent cutting units 2 can be made so that it widens from the top to the bottom of the removed portion 5. In a preferred arrangement, the removed portion 5 constantly tapers from the top to the bottom of the substrate 1. However, it may also be possible to reduce the possibility of scrap material becoming trapped by enlarging the width of the removed portion 5 from the top of the substrate 1 to a vertical point above the bottom of the substrate 1, or by enlarging the width of the removed portion from a vertical point below the top 41 of the substrate 1 to the bottom 42 of the substrate 1.

The possibility of the scrap material becoming trapped in the die 1 may also reduced by the rule 3 itself and/or the mounting orientation of the rule 3. The rule 3 is preferably formed such that the passageway or gap between the adjacent rule 3 increases downward along at least a portion of the height of the rule 3, preferably along a portion of the upper half of the rule 3. Various examples of rule 3 providing such an arrangement are shown in FIGS. 3–6.

Figure 7:
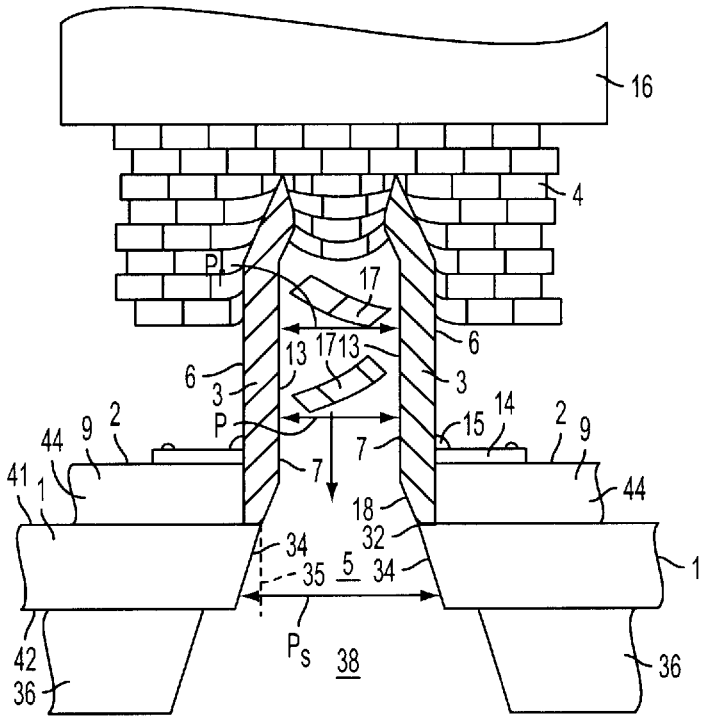
FIG. 7 is a sectional view taken along lines 7—7 of FIG. 1.

If desired, as shown in FIG. 7, a removed portion 38 in the lower platen 36 may be provided so that the cut scrap material that fall from the die 50 at the cutting station can be expelled there. This removed portion may be provided with tapered sidewall so that the passageway through it enlarges from top to bottom. If the platen 36 does not include such a removed portion, the cut scrap material 4 will separate from the die 50 due to gravity and the jarring that occurs when the die 50 is moved from the cutting station on the roller conveyor, or in subsequent cutting operations. While this platen 36 is depicted as solid in FIGS. 8–10, it is recognized that a removed portion 38 may also be provided in these arrangements.

FIG. 7 depicts the passageway P, along with a first embodiment of attachment arrangements between the rule 3 and the substrate 1. The die 50 consists of a primary substrate 1 and cutting units 2. The cutting units 2 each include rule 3 in a desired pattern, and the units 2 are attached to the base 9. In the embodiment of FIG. 7, the base 9 is a secondary substrate 44, preferably made from wood. The rule 3 is attached around the periphery of the secondary substrate 44. In a preferred arrangement, the rule 3 is attached to the secondary substrate 44 with a steel tab .14. The steel tab 14 is screwed into, or otherwise attached to, the secondary substrate 44, and is welded to the steel rule 3 at weld 15. Each secondary substrate 44 can be attached to the primary substrate 1 by any appropriate fastening technique. Preferred attachment arrangements include known fastening hardware, e.g., screws, nuts, bolts, and adhesives.

The rule 3 preferably includes a recessed portion or undercut 13. That is, the outer surface 7 of rule 3 moves closer towards the inside of the cutting unit 2 at one or move locations from its top to its bottom. Thus, when pieces of rule 3 for adjacent cutting units 2 are close to each other, the undercut 13 in the rule 3 causes the passageway P, and more specifically the rule passageway $P_r$, to widen. This minimizes the possibility that the scrap material 17 will get stuck between the outer sidewalls of the rule 3 of adjacent cutting units 3.

Figure 9:
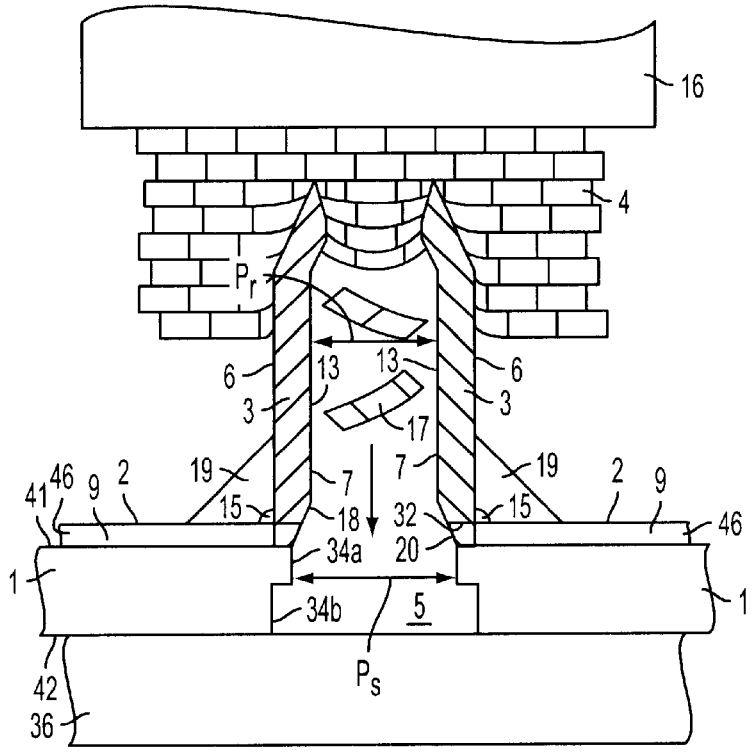
FIG. 9 is a sectional view similar to FIG. 7 showing a second alternative rule mounting arrangement.

The substrate 1 also preferably has a removed portion 5 in the region generally below the rule passageway $P_r$ such that the passageway P is comprised of the rule passageway $P_r$ and the substrate passageway $P_s$. The rule 3 is preferably arranged to partially overhang the removed portion 5 in the substrate 1 and a portion of the thickness of the rule 3 is above the remaining substrate 1 for vertical support. If desired, the rule 3 may overhang the removed portion 5 in the substrate 1 by 30% of the thickness of the rule or more. The removed portion 5 in the substrate 1 may be formed by vertical or angled sidewalls 34. Angled sidewalls 34 enable the width of the substrate passageway $P_s$ to increase the entire height of the substrate 1 or at least from some point from the top surface 41 of the substrate 1 to the bottom surface 42 of the substrate 1. If desired, the sidewalls 34 can have a constant angle 35 from the vertical. In a preferred arrangement, this angle 35 is between 5 and 60 degrees, and is preferably between 30 and 45 degrees. However, the present invention contemplates all angles, and preferably those 60 degrees and smaller. If desired, increasing the width of the substrate passageway $P_s$ can be achieved by using stepped vertical sidewall surfaces 34*a* and 34*b* in lieu of the angled sidewalls. Such an arrangement is shown in FIG. 9. If desired, stepped sidewall surfaces 34*a*, 34*b* could be used in any of the disclosed arrangements.

Optionally, the bottom outside portion of the rule 3 can be formed with a small chamfer 18 that further increases the passageway P in that region. In FIG. 7, the chamfer 18 is shown as approximately matching the slope of the taper in the removed portion 5 in the substrate 1. The shape of the undercut 13 in the rule 3, the chamfer 18 in the rule 3, and the taper in the removed portion 5 in the substrate 1 can be formed in any shape desired.

As the scrap material 17 is cut, any increases in the width of the passageway P from the cutting edge 8 of the rule 2 to the bottom surface 42 of the substrate 1 will tend to facilitate the falling and passing of the pieces of scrap material 17. As shown in the figures, these increases can be due to any undercuts the rule 3 and/or taperings of the removed portion in the substrate 1 so that it widens toward the bottom of the removed portion 5. Such widenings are also advantages when the scrap material 17 is temporarily lodges between the rule 3. These widenings enhance the ability of subsequent cut pieces of scrap material 17 to push the lodged scrap material 17 downward along the passageway P for discharge from the die 50 instead of becoming lodged and damaging the die 50.

Figure 8:
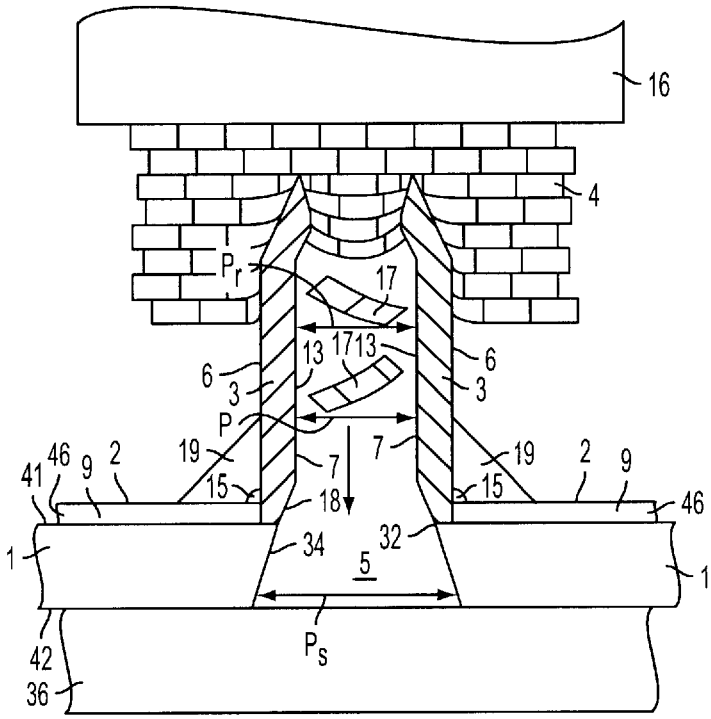
FIG. 8 is a sectional view similar to FIG. 7 showing an alternative rule mounting arrangement.

FIG. 8 shows a second embodiment of the attachment between the rule 3 and the substrate 1. This embodiment differs from that of FIG. 7 in that the base 9 is made of sheet metal 46, rather than a wood substrate 44. The rule 3 is welded to the lateral periphery of the sheet metal 46 with a weld 15. Each sheet metal base 46 can be attached to the primary substrate 1 by any appropriate fastening technique including those as described above. In order to strengthen the rule 3, one or more gusset brackets 19 can be added between the rule 3 and the sheet metal 46. The gusset brackets 19 are preferably welded to the rule 3 and to the sheet metal 46. Gusset brackets 19 can be added at regular intervals that are sufficiently close to adequately strengthen the rule 3.

FIG. 9 shows a third embodiment of the attachment between the rule 3 and the base 9. This embodiment differs from that of FIG. 8 in that the rule 3 is supported on top of the periphery of the sheet metal base 46 and not welded at the lateral periphery. In this embodiment, the side of the base 9 may be formed with an angled outer edge 20. This angled edge 20 forms part of the passageway P between the rule and substrate passageways further facilitates removal of small pieces of scrap material 17 as they pass through the removed portion 5 in the primary substrate 1.

Figure 10:
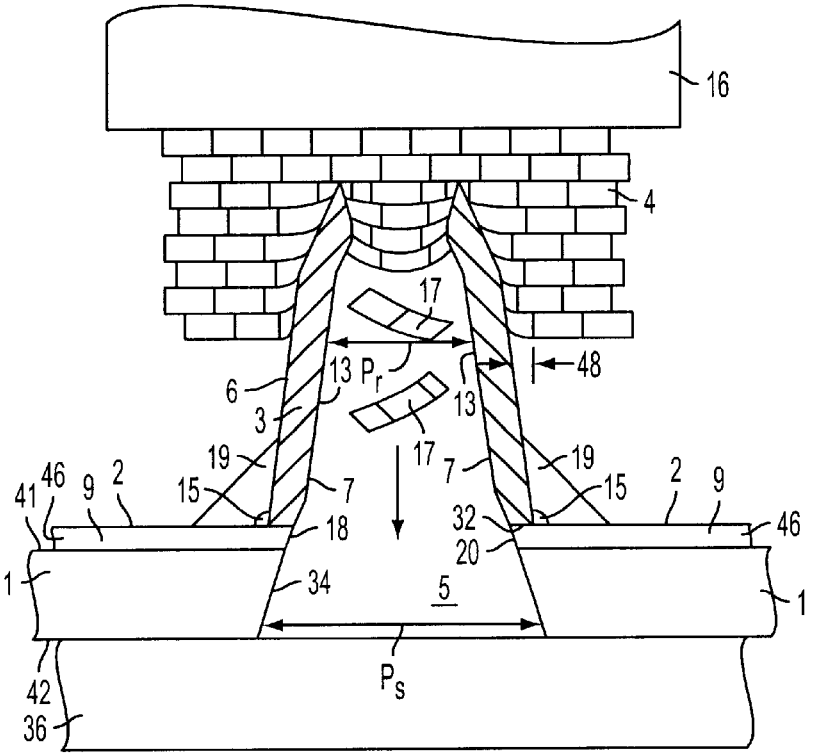
FIG. 10 is a sectional view similar to FIG. 7 showing a third alternative rule mounting arrangement.

FIG. 10 shows a fourth embodiment of the attachment arrangement of the rule 3 to the substrate 1. In this embodiment, the rule 3 is not vertically mounted. Rather, the rule 3 is mounted by an angle 48 from the vertical so that the sections of rule 3 of adjacent cutting units 2 slope toward each other. In this arrangement, the angle 48 or slope of the rule 3 causes the cutting edges 8 of the rule to be closer to each other and the bottom portions 32 of the rule 3 to be further apart from each other. This, in turn, increases the width of the passageway $P_r$ between the rule 3. Preferred range for angle 48 includes all angles within one to two degrees, and more generally all angles greater than zero degrees and less than or equal to five degrees. While the rule 3 in this embodiment is shown as including an undercut 13 or recessed portion, such an undercut is not necessary to obtain an increased rule passageway $P_r$ due to the angle 48 of the rule 3. However, the use of such an undercut 13 could be used as shown in FIG. 10 to obtain a further increase in the width of the passageway P.

The benefits of the widening passageway of present invention are believed to be maximized in regions where the horizontal distance or gap between the cutting edges 8 of adjacent cutting units 2 is 0.25 inches or less, with the benefits further increasing as this gap becomes smaller. This invention contemplates the use of a widening passageway as shown and described herein for all distances, specifically for gaps of all distances 0.25 inches or less, including but not limited to 0.1875 inches, 0.125 inches and 0.0625 inches.

Examples of some desired rule shapes are shown in FIGS. 3–6. Each rule 3 includes a top that includes a cutting edge 8 and a bottom or base 32 at its other vertical end. The rule 3 is preferably provided in elongated strips which may be cut into lengths, and optionally coiled for reduction of scrap. The lengths of the rule 3 may preferably be provided in commonly used lengths such as 200 feet, if coiled, or 3 feet if flat. However, the rule 3 may be provided in different sized lengths such as 1 foot, 2 feet, or any desired length. The rule 3 is preferably heat treated for hardening purposes, and sharpened in manners known in the art. Further, the cutting edge 8 of the rule 3 is preferably serrated in a manner known in the art. The elongated strips of rule 3 may later be cut to size and bent to the shapes of the individual cutting units 2.

The undercut 13 allows the outer wall 7 surface of rule 3 to extend inwardly from its outward most point so that the passageway P, and more specifically the rule passageway $P_r$, between adjacent cutting units 2 is wider at various points along its height has compared to the region adjacent to and below the cutting edge 8. Thus, the passageway P is wider near the substrate 1 and narrower near the cutting edges 8 of the rule 3.

Figure 3:
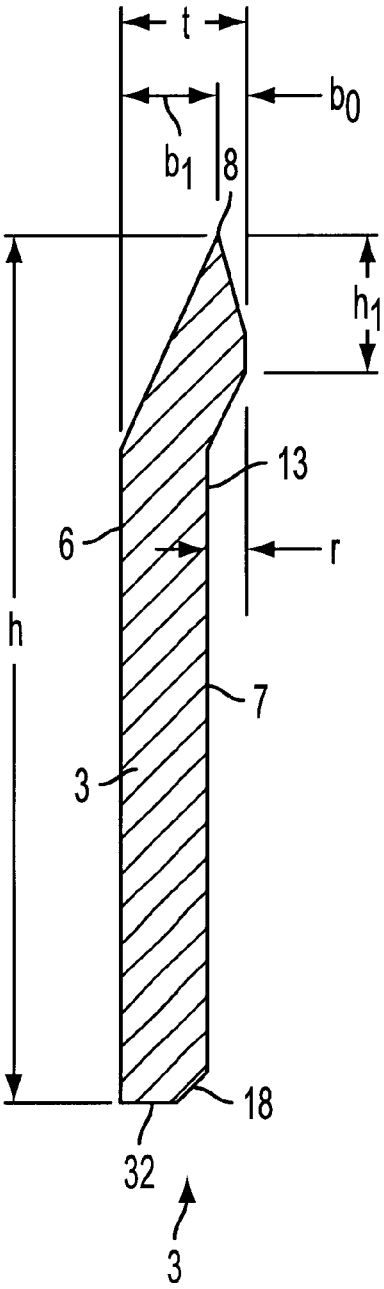
FIG. 3 shows a first embodiment of the rule to be used in the die according to the present invention.
Figure 6:
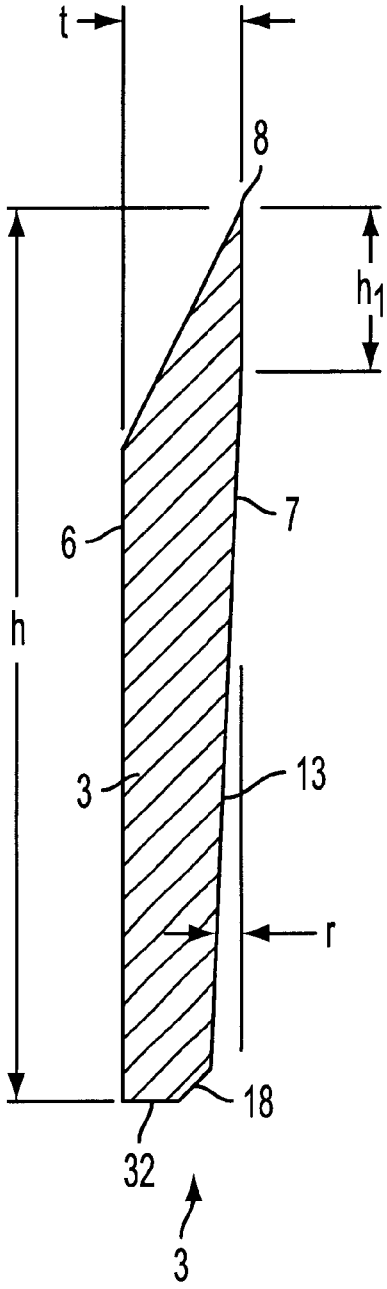
FIG. 6 shows a fourth embodiment of the rule to be used in the die according to the present invention.
Figure 4:
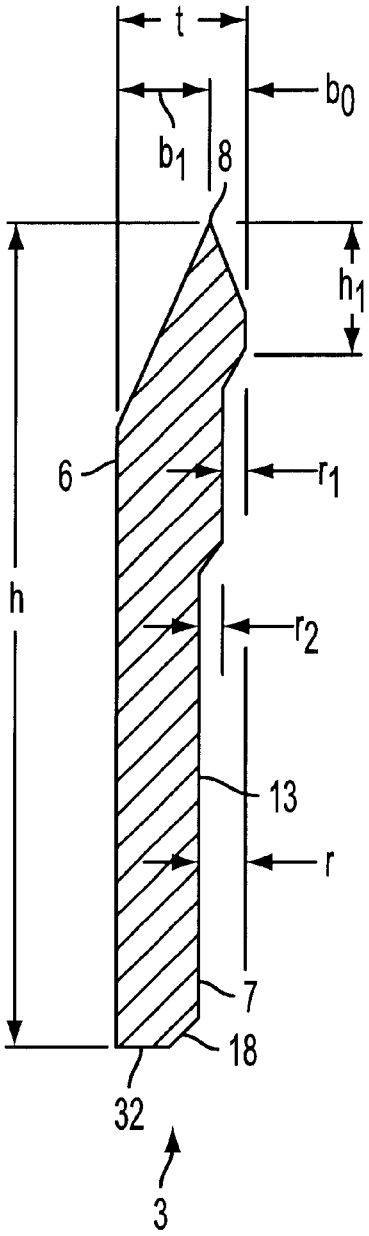
FIG. 4 shows a second embodiment of the rule to be used in the die according to the present invention.
Figure 5:
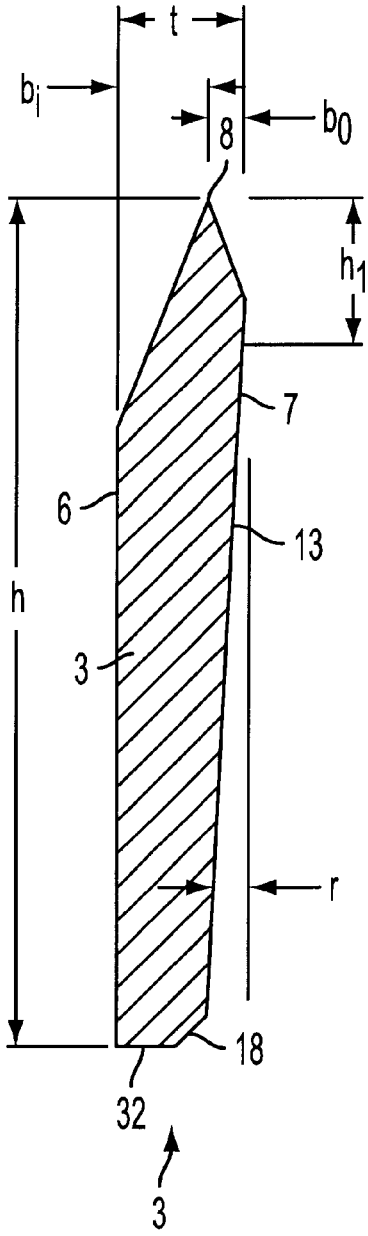
FIG. 5 shows a third embodiment of the rule to be used in the die according to the present invention.

The rule 3 is typically between 0.75 and 3.0 inches in height h. In a preferred embodiment, such as shown in FIGS. 3–5, the cutting edge is beveled such that it defines an inner or major bevel $b_i$ and an outer or minor bevel $b_o$. The inner bevel $b_i$ is the bevel from the cutting edge 8 to the inner-most portion of the rule 3, which is the side 6 of the rule 3 that would be facing the inside of the cutting unit 2. The outer bevel $b_o$ is the bevel from the cutting edge 8 to the outer-most portion of the rule 3, which is the side 7 of the rule 3 that would be facing out from the inside of the cutting unit 2 and facing an adjacent cutting unit 2. However, it is also possible to use an edge or side bevel such as is shown in FIG. 6.

The preferred maximum thickness t of the rule 3 is preferably 0.083 inches but other rule thicknesses between 0.041 and 0.160 inches can also preferably be used. The major or inner bevel $b_i$ is preferably about 86% of this thickness but other bevels may be used. A commonly used minor bevel $b_o$ is 0.012–0.015 inches. The horizontal component of the cumulative undercuts or recesses 13 may be less than, the same as, or more than the minor bevel $b_o$. Thus, the outer wall surface 7 of rule 3 may extend horizontally to or inside of the cutting edge 8. The undercuts or recesses 13 be stepped, such as those shown in FIGS. 3 and 4, or may be elongated and gradual, such as those shown in FIGS. 5 and 6. The stepped undercuts 13 may be angled as shown in FIGS. 3 and 4, or it may be formed to be horizontal, not shown, so as to provide a horizontal wall surface.

In each embodiment, the undercut 13 preferably begins relatively close to the top of the rule 3. Specifically, the first undercut 13 preferably begins about 0.25 inches from the top of the rule 3. The outer wall surface 7 should extend inward from its outer-most spot for all or substantially all of its length down to the bottom of the rule 32. While the undercut 13 begins in the upper half or 50% of the rule 3, the benefits of such an undercut 13 are maximized as the top of the rule 3 are approached as long the combination of location and depth of the undercut 13 does not affect the strength of the rule 3. The closer to the undercut 13 is located to the cutting edge 8, the earlier the cut scrap material 17 has the ability to expand and minimize the possibility of becoming stuck between the adjacent rule 3. Balancing these factors, it is preferred that the undercut 13 can begin anywhere from 5%–50% of the height down from the top of the rule 3. The undercut 13 preferably begins close to the termination point of the minor bevel $b_o$.

The rule 3 shown in FIG. 3 includes a single primary undercut 13 such that the outer wall surface 7 horizontally extends substantially to or horizontally inwardly beyond the cutting edge 8. This undercut 13 is stepped forming two wall sections that may be vertical. Accordingly, the horizontal recess thickness r of this undercut is preferably substantially equal to or greater than the width of the minor bevel $b_o$.

The rule of FIG. 4 differs from that of FIG. 3 in that the primary undercut 13 is two-stepped which forms three vertical wall surface sections, two of which are recessed. The horizontal recess thickness of the first recess $r_1$ and the horizontal recess thickness of the second recess $r_2$ form a total horizontal recess thickness r. As in the FIG. 3 embodiment, the total horizontal thickness r of this undercut is preferably substantially equal to or greater than the width of the minor bevel $b_o$.

The rule of FIG. 5 differs from that of FIG. 3 in that the undercut 13 results in an angled outer wall surface 8 instead of one or more vertical wall sections. Basically, the undercut 13 shown in FIG. 5 is formed as a linear taper into the thickness of the rule whereas the undercut 13 is formed as one or more discrete stairstep tapers in FIG. 3 and 4.

It is evident that in this embodiment, the horizontal recess thickness r of undercut 13 gradually increases, which in turn results in the gradual increase in the width of passageway P. The horizontal recess thickness r of this undercut at its largest recess point is preferably substantially equal to or greater than the width of the minor bevel $b_o$. However, it is recognized that the horizontal recess thickness r of this undercut need not extend in that far to reap advantages.

Another embodiment of the rule 3 is shown in FIG. 6. This rule 3 is a side bevel rule and accordingly, does not include a minor bevel. The undercut 13 is similar to that shown in FIG. 5. The undercut 13 can be formed in any shape as long as the undercut becomes wider from the top of the rule near the cutting edge 8 to the bottom of the rule where the rule attaches to the substrate 1. The undercut 13 could conceivably be formed in a curved shape or it could consist of one or more stairsteps as shown in FIGS. 3 and 4. The invention contemplates any combination of bevel type and undercut 13.

The bottom outside of the rule in FIGS. 3–6 are shown as having a chamfer 18. This provides a further increase in the width of the passageway P at the lower end of the rule 3. One preferred arrangement of such a chamfer 18 would extend 0.030 inches in from the outer sidewall and would preferably match the angle of the sidewall of the removed portion of substrate 1. In height, the chamfer 18 preferably extends at least 0.025 inches, and may extend 0.050 inches, or higher. However, such a chamfer 18 need not match the substrate cutout angle. It is understood that while the bottom outside of the rule in the figures need not be chamfered.

Each of these embodiments provides an undercut or recessed portion 13 that begins a distance $h_1$ from the top of the rule 3. The beginning height $h_1$ of the first recess is preferably 0.1875 inches from the top or cutting edge 8 of the rule 2. However, the height of the first recess may be more or less than this amount, with preferred ranges being between slightly less than 0.1875 inches to 0.5 inches. The best results should be obtained by using the smallest value of the beginning recess height without adversely impacting the strength of the rule 3. More than one recess 13 may be used such as shown in FIG. 4. The inside surfaces 6 of the rule 3 preferably remain straight and vertical and perpendicular to the substrate 1 if mounted in a manner shown in FIGS. 7–10.

The undercut 13 need not be on the entire length of rule 3 used for the cutting unit 2. If desired, the undercut or undercuts 13 may only be made in the areas where the adjacent cutting units 2 are close to each other and an increased passageway width will provide the desired benefits. Further, if desired, a portion of the outer bevel $b_o$ may be ground down in areas of extremely small gaps between adjacent rule 3 to widen the passageway in that region.

As can be seen from the drawings the thickness of the rule 3, as well as the spacing between the outer wall 7 and the plane defined by the inner wall 6, can decrease downward along its height, between the beveled upper portion and the vertical midpoint of the rule. Further, the recess can begin below the point where the bevel intersects the outer wall 7 and above the height where the bevel intersects the inner wall 6 such that the outer wall 7 approaches the plane of the inner wall 6 above the height where the bevel intersects the inner wall 6. The outer wall 7 may also approach the plane defined by the inner wall 6 at two points above the vertical midpoint of the rule and/or at one point above the vertical midpoint of the rule and one point below the vertical midpoint of the rule. Other features and attributes of the rule 3 may be ascertained from the drawing figures.

The rule 3 may be formed by using standard rule and grinding off the regions necessary to form the undercuts or recesses. In the alternative, the rule 3 may be formed by using a steel block having a jog or offset portion that corresponds to the step of the undercut, and grinding the desired bevel into that structure. In another alternative formation method, the desired shape can initially be formed by rolling and subsequently ground as necessary.

It is noted that while FIGS. 3–6 depict various rule profiles and FIGS. 7–11 depict various rule mounting arrangements, any of the rule profiles may be used with any of the mounting arrangements. Further, different rule profiles and/or different rule mounting arrangements may be used in the same die provided that they are vertically compatible for evenly cutting the material. In fact, all combinations of the rule profiles may be used in a single testing die to determine the relative effectiveness of the rule profiles under various circumstances.

Figure 2:
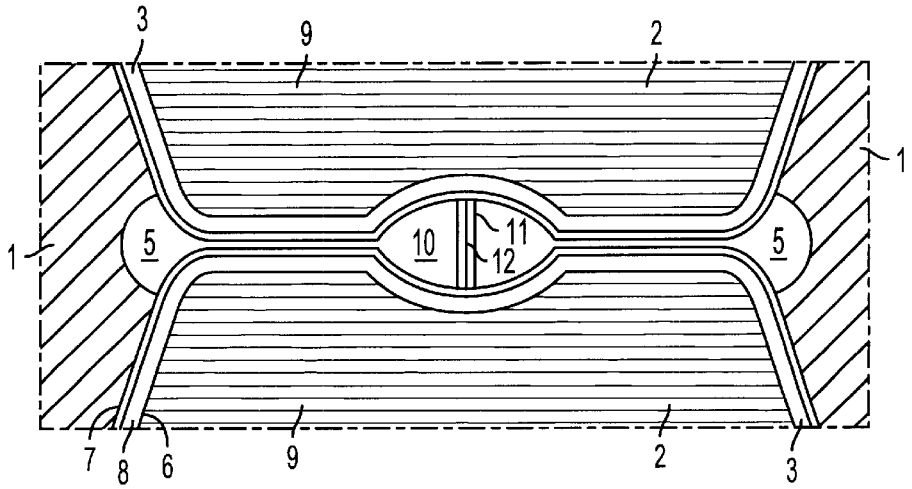
FIG. 2 is a detailed view of encircled region 2 of FIG. 1.
Figure 13:
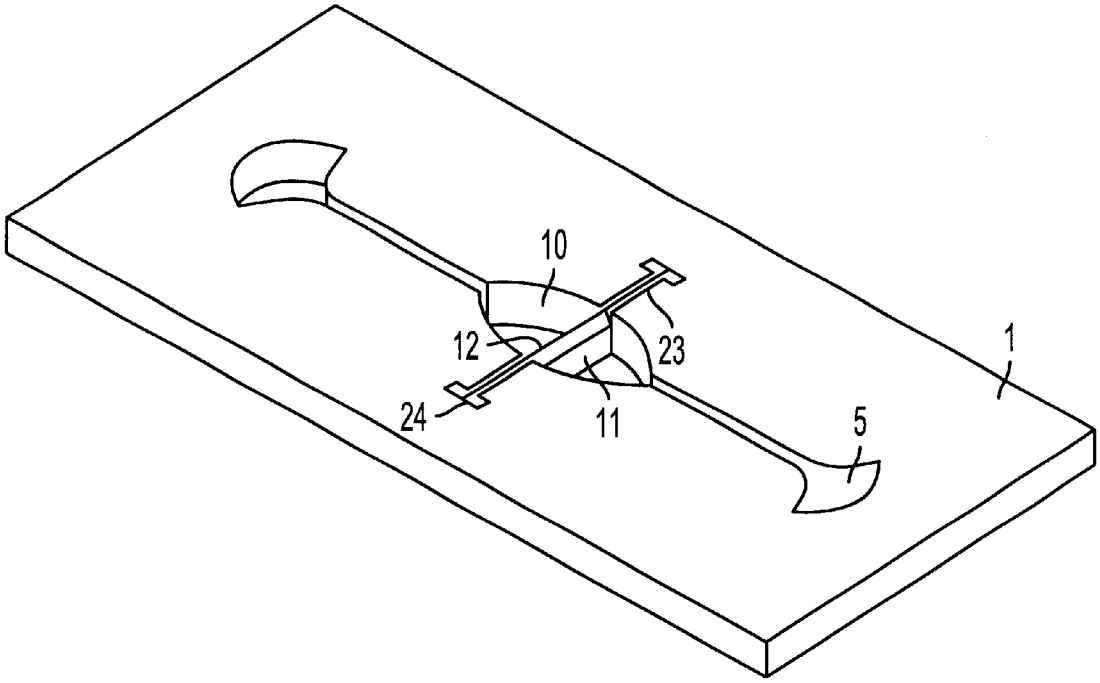
FIG. 13 is a perspective view of a portion of the substrate of the die of the present invention showing a sharpened support insert.

Referring to FIGS. 2 and 13, the gap between adjacent cutting units 2 may widen for a short space as denoted by reference numeral 10. This may be due to the desired patterns to the cut in the fabric. In such a widening or wandering gap 10 between adjacent cutting units 2, the substrate 1 is also preferably removed below this region. To prevent weakening of the substrate 1 in these areas and in areas where the removed portion 5 of substrate 1 is very long, a support insert 11 can be included in the substrate 1 that provides reinforcing. The support insert 11 includes a sharpened upper edge 12 that cuts up small pieces of scrap material and facilitates their ability to pass through the removed portion 5 in the substrate 1. The support insert 11 is preferably the same in height as the substrate 1 is in thickness, and the support insert 11 preferably does not extend up above the top surface 41 of the substrate 1. A preferred method to attach the insert 11 within the substrate 1 is to provide a slot 23 formed in the substrate 1 which is transverse to the length of the removed portion 5. The support insert 11 is complimentary in shape to the slot 23 to provide a tight fit therebetween. If desired, the slot 23 and the support insert 11 may be T-shaped 24 to provide a tight fit. Supplemental holding devices can also be used.

Figure 11:
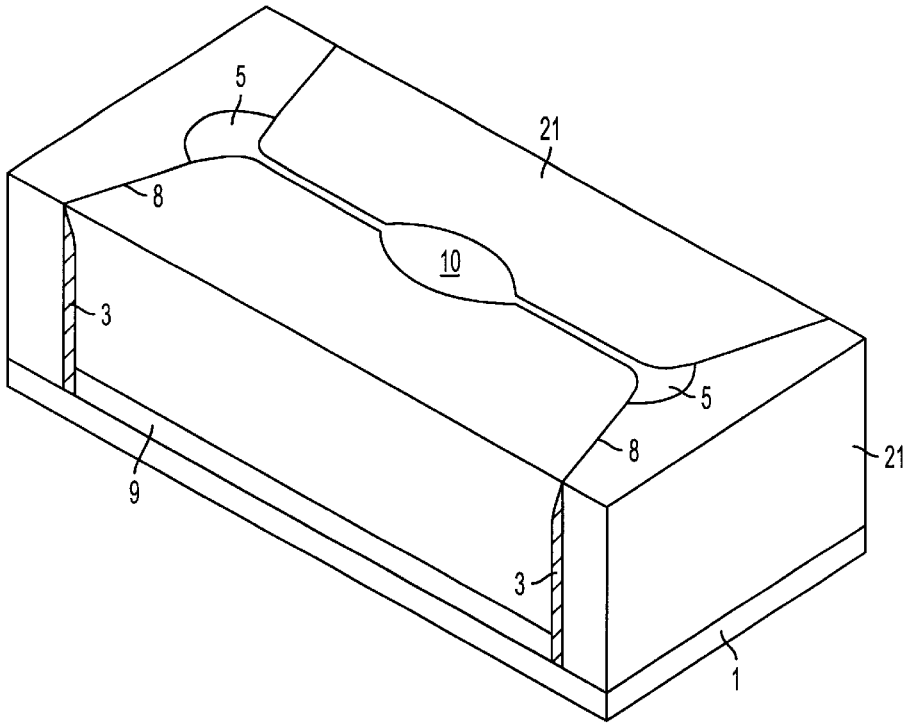
FIG. 11 is a perspective view of a portion of the die of the present invention with ejection foam used therein.

FIG. 11 shows a perspective view of a portion of a die with ejection foam 21 mounted thereon to facilitate ejection of material form the die. The ejection foam 21 is attached to the substrate 1 by any suitable method. The ejection foam 21 extends upwardly from the upper surface of base 9 and from the upper surface 41 of the substrate 1 to approximately the cutting edge 8 of the rule 3. The ejection foam 21 is resiliently compressible so that the material compresses it during a cutting operation. After the material has been cut, the ejection foam 21 expands to its original height, thereby forcing the cut material out of the die and assisting with removal of material from the die 50. In the area between adjacent cutting units, where the cutting units are closely spaced, there is no ejection foam 21. The ejection foam 21 has a removed portion 5 that corresponds to the removed portion 5 of the substrate 1. The ejection foam 21 is not included between adjacent cutting units 2 to allow small pieces of scrap material and lint to pass through to the bottom of the die 50. In the area of a wandering gap 10, the ejection foam 21 is also omitted in areas to correspond to the removed portion of substrate 1.

Figure 12:
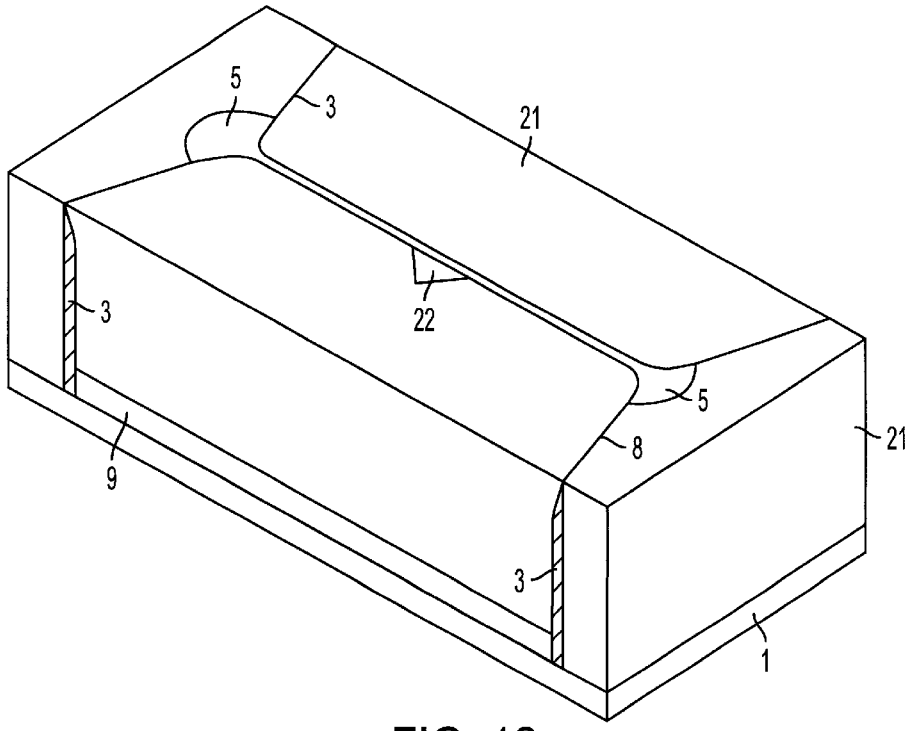
FIG. 12 is a perspective view of a portion of the die similar to FIG. 11 but showing a marker notch between adjacent cutting units.

FIG. 12 shows a perspective view of a portion of the die 50 with ejection foam 21 and a marker notch 22. Where a marker notch 22 exists, a small triangular piece of scrap material is generated. The ejection foam 21 is omitted in the interior portion of the marker notch to facilitate removal of the small triangular piece of scrap material.

Figure 14:
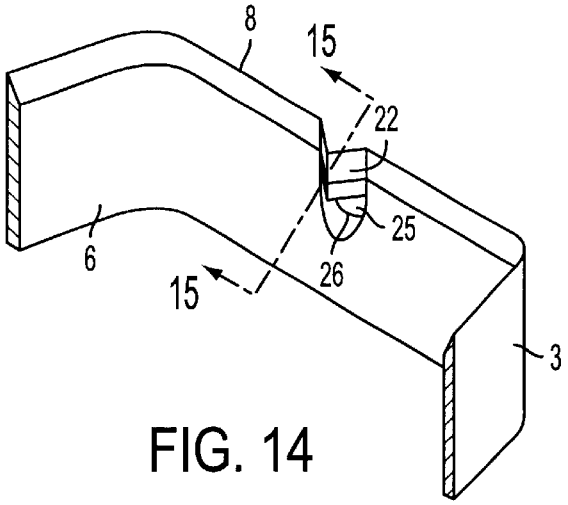
FIG. 14 is a perspective view of a portion of rule for use in the present invention showing a marker notch.
Figure 15:
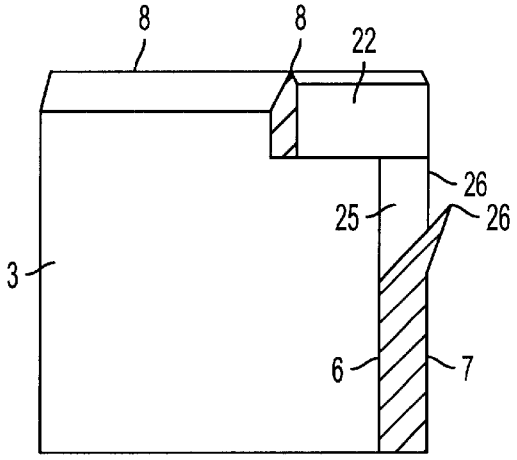
FIG. 15 is a cross-sectional view taken along lines 15—15 of FIG. 14.

FIG. 14 shows a portion of rule 3 with a marker notch 22 formed therein. The marker notch 22 is formed in a top portion of the rule 3 and a hole 25 is provided in the rule 3 underneath of the notch to facilitate the removal of cut scrap material. The lower end of the hole 25 in the rule 3 has a sharpened upper edge 26 that cuts the scrap material and facilitates its removal. A sectional view of the marker notch 22 is shown in FIG. 13. The rule 3 can be seen to have an inner side 6 that is oriented toward the center of the cutting unit 2 and an outer side 7 that is oriented away from the cutting unit 2. The sharpened edge 26 on hole 25 is preferably deformed outward to angle slightly toward the outer side 7 of the rule 3. This can be done by drilling a hole 25, forming the notch 22, and bending the edge 26 outward with a tool. If the marker notch is shaped as in the embodiment shown in FIGS. 14 and 15, the removed portion 5 in the substrate 1 corresponds to the spacing between the hole walls irrespective of the shape of the marker notch 22. In this embodiment, the cut scrap material 17 from the marker notch 22 will fall into the center of the cutting unit 2 where it can be removed by hand by an operator.

Figure 16:
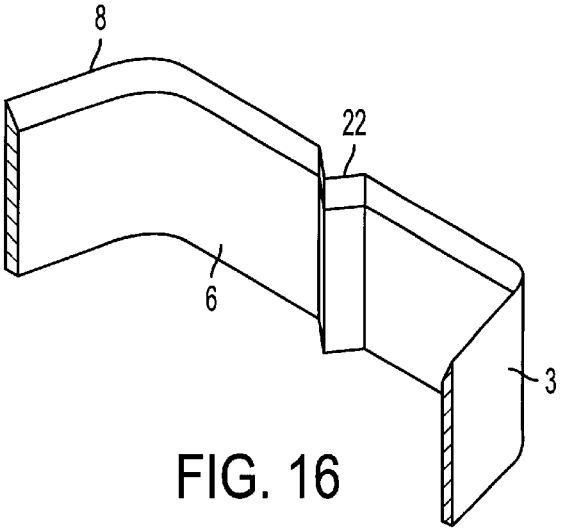
FIG. 16 is a perspective view of a portion of rule showing an alternative embodiment of a marker notch.

An alternative embodiment of marker notch is shown in FIG. 16. Here the marker notch 22 is formed over the entire height of the rule 3. In this case, the removed portion 5 of the substrate 1 would substantially conform to the spacing between the cutting units 2 including the shape of the marker notch 22 so that scrap material from the marker notch 22 can pass downward through the bottom of the die.

While preferred embodiments of the invention have been shown and described, it will be apparent to those skilled in the art that various modifications may be made in these embodiments without departing from the scope of the invention. Therefore, it is intended that the invention not be limited to the particular embodiments disclosed but that the scope of the invention be defined by the following claims.

What is claimed is:

1. A strip of sharpened and heat-treated rule for use in a cutting die comprising:

a lower base section;

an offset beveled upper portion having a cutting edge, a minor bevel and a major bevel;

a first substantially planar vertical sidewall extending from the lower base section to the beveled upper portion, said first sidewall being on the side of the rule having the major bevel, said major bevel intersecting said first sidewall at a first height;

a second sidewall extending from the lower base section to the beveled upper portion, said second sidewall being on the side of the rule having the minor bevel, said minor bevel intersecting said second sidewall at a second height, said second height being above said first height, wherein said second sidewall laterally approaches the first sidewall in at least one region from the second height downward to the first height.

2. The rule of claim 1, wherein the first sidewall and at least a portion of the second sidewall are on the same horizontal side of the cutting edge.

3. The rule of claim 2, wherein said lower base section has a chamfer in excess of 0.030 inches in height on the side of the rule having the minor bevel and not on the side of rule having the major bevel.

4. The rule of claim 1, wherein said cutting edge is serrated.

5. A strip of sharpened and heat-treated rule for use in a cutting die comprising:

a bottom;

an offset beveled upper portion having a cutting edge, a minor bevel and a major bevel;

a first sidewall extending from the bottom to the beveled upper portion, said first sidewall being on the side of the rule having the major bevel, said major bevel intersecting said first sidewall at a first height;

a second sidewall extending from the bottom to the beveled upper portion, said second sidewall being on the side of the rule having the minor bevel, said minor bevel intersecting said second sidewall at a second height that is above said first height, wherein said second sidewall laterally approaches the first sidewall in at least one region from the second height downward to the first height;

wherein the rule includes a thickness defined as the distance between the first and second sidewalls, and wherein the thickness of the rule decreases from a first vertical location on the rule to a second vertical location on the rule below the first vertical location, wherein both said first and second vertical locations are between the beveled upper portion and a vertical midpoint of the rule;

wherein the second sidewall is stepped and includes distinct first, second, and third sidewall surfaces, the first sidewall surface of the second sidewall is vertically elongated and is substantially parallel to the first sidewall.

6. The rule of claim 5, wherein the stepped second sidewall surface of the second sidewall is vertically elongated and is substantially parallel to the first sidewall.

7. The rule of claim 5, wherein said cutting edge is serrated.

8. A strip of sharpened and heat-treated rule for use in a cutting die comprising:

a lower base section;

an offset beveled upper portion having a cutting edge, a minor bevel and a major bevel;

a cutting edge plane defined as a vertical plane coincident with the cutting edge;

a first substantially planar sidewall extend over base section to the beveled upper portion and defining a second vertical plane, said first substantially planar sidewall being on the side of the rule having the major bevel;

a second sidewall extending from the lower base section to the beveled upper portion, said second sidewall being on the side of the rule having the minor bevel;

wherein the lateral distance between said second sidewall and said second vertical plane decreases along the height of the rule in the direction from the beveled upper portion to the lower base section, wherein the second sidewall is stepped, and wherein at least a portion of the second sidewall is horizontally located between the first substantially planar sidewall and the cutting edge plane.

9. The rule of claim 8, wherein the lateral distance between said second sidewall and said second plane decreases from the upper portion to a point above a vertical midpoint of the rule.

10. The rule of claim 9, wherein said cutting edge is serrated.

11. A strip of sharpened and heat-treated rule for use in a cutting die comprising:

a bottom;

an offset beveled upper portion having a cutting edge, a minor bevel and a major bevel; a first sidewall extending from the bottom to the beveled upper portion, said first sidewall being on the side of the rule having the major bevel;

a second sidewall extending from the bottom to the beveled upper portion, said second sidewall being on the side of the rule having the minor bevel;

wherein the rule includes a thickness defined as the distance between the first and second sidewalls, and wherein the thickness of the rule decreases from a first vertical location on the rule to a second vertical location on the rule below the first vertical location, wherein both said first and second vertical locations are between the beveled upper portion and a vertical midpoint of the rule;

wherein the second sidewall is stepped and includes distinct first, second, and third sidewall surfaces, the first sidewall surface of the second sidewall is vertically elongated, and wherein the first, second, and third sidewall surfaces of the second sidewall are each substantially parallel to the first sidewall.

12. The rule of claim 11, further comprising a cutting edge plane defined as a vertical plane coincident with the cutting edge, wherein the first sidewall and at least a portion of the second sidewall are on the same horizontal side of the cutting edge plane.

13. A strip of sharpened and heat-treated rule for use in a cutting die comprising:

a lower base section;

an offset beveled upper portion having a cutting edge, a minor bevel and a major bevel;

a first substantially planar sidewall extending from the lower base section to the beveled upper portion and defining a vertical plane, said first substantially planar sidewall being on the side of the rule having the major bevel;

a second sidewall extending from the lower base section to the beveled upper portion, said second sidewall being on the side of the rule having the minor bevel;

wherein the lateral distance between said second sidewall and said plane decreases along the height of the rule in the direction from the beveled upper portion to the lower base section, wherein the second sidewall is stepped;

wherein the lateral distance between said second sidewall and said plane decreases from a point above a vertical midpoint of the, rule to a point below the vertical midpoint of the rule.

14. A strip of sharpened and heat-treated rule for use in a cutting die comprising:

a lower base section;

an offset beveled upper portion having a cutting edge, a minor bevel and a major bevel;

a first substantially planar sidewall extending from the lower base section to the beveled upper portion and defining a vertical plane, said substantially planar first sidewall being on the side of the rule having the major bevel;

a second sidewall extending from the lower base section to the beveled upper portion, said second sidewall being on the side of the rule having the minor bevel;

wherein the lateral distance between said second sidewall and said plane decreases along the height of the rule in the direction from the beveled upper portion to a lower base section, wherein the second sidewall is stepped; and wherein said lower base section has a chamfer in excess of 0.025 inches in height on the side of the rule having the minor bevel and not on the side of rule having the major bevel.

15. A strip of sharpened and heat-treated rule for use in a cutting die comprising:

a lower base section;

an offset beveled upper portion having a cutting edge, a minor bevel and a major bevel;

a cutting edge plane defined as a vertical plane coincident with the cutting edge;

a first substantially vertical sidewall extending from the lower base section to the beveled upper portion, said first substantially vertical sidewall being on the side of the rule having the major bevel;

a second sidewall extending from the lower base section to the beveled upper portion, said second sidewall being on the side of the rule having the minor bevel;

wherein at least a portion of the second sidewall is horizontally located between the first sidewall and the cutting edge plane.

16. A cutting die comprising:

a substrate, and a strip of sharpened and heat-treated rule coupled to the substrate having:

a bottom;

an offset beveled upper portion having a cutting edge, a minor bevel and a major bevel;

a first sidewall extending from the bottom to the beveled upper portion, said first sidewall being on the side of the rule having the major bevel, said major bevel intersecting said first sidewall at a first height;

a second sidewall extending from the bottom to the beveled upper portion, said second sidewall being on the side of the rule having the minor bevel, said minor bevel intersecting said second sidewall at a second height that is above the first height, wherein said second sidewall laterally approaches the first sidewall in at least one region from the second height downward to the first height;

wherein the rule includes a thickness defined as the distance between the first and second sidewalls, and wherein the thickness of the rule decreases from a first vertical location on the rule to a second vertical location on the rule below the first vertical location, wherein both said first and second vertical locations are between the beveled upper portion and a vertical midpoint of the rule;

wherein the second sidewall is stepped and includes distinct first, second, and third sidewall surfaces, the first sidewall surface of the second sidewall is vertically elongated and is substantially parallel to the first sidewall.

17. A cutting die comprising:

a substrate, and a strip of sharpened and heat-treated rule coupled to the substrate having:

a lower base section;

an offset beveled upper portion having a cutting edge, a minor bevel and a major bevel;

a cutting edge plane defined as a vertical plane coincident with the cutting edge;

a first substantially planar sidewall extending from the lower base section to the beveled upper portion and defining a second vertical plane, said first substantially planar sidewall being on the side of the rule having the major bevel;

a second sidewall extending from the lower base section to the beveled upper portion, said second sidewall being on the side of the rule having the minor bevel;

wherein the lateral distance between said second sidewall and said second vertical plane decreases along the height of the rule in the direction from the beveled upper portion to the lower base section, wherein the second sidewall is stepped; and wherein at least a portion of the second sidewall is horizontally located between the first sidewall and the cutting edge plane.

* * * * *